United States Patent [19]

Fowler

[11] Patent Number: 4,519,418

[45] Date of Patent: May 28, 1985

[54] WATER WELL PUMPING SYSTEM

[76] Inventor: L. B. Fowler, Rte. 1, Box 339, Sâsakwa, Okla. 74867

[21] Appl. No.: 581,004

[22] Filed: Feb. 17, 1984

[51] Int. Cl.[3] ..... E03B 11/00

[52] U.S. Cl. ..... 137/571; 137/568

[58] Field of Search ..... 137/568, 571, 576; 405/39; 417/38

[56] References Cited

U.S. PATENT DOCUMENTS

| | | | |
|---|---|---|---|
| 3,739,810 | 6/1973 | Horan, Jr. | 137/568 |
| 4,216,796 | 8/1980 | Gastrock | 137/571 |
| 4,304,526 | 12/1981 | Shetler, Sr. | 417/38 |

FOREIGN PATENT DOCUMENTS

| | | | |
|---|---|---|---|
| 328389 | 8/1935 | Italy | 137/568 |

*Primary Examiner*—Martin P. Schwadron
*Assistant Examiner*—John A. Rivell
*Attorney, Agent, or Firm*—Robert K. Rhea

[57] ABSTRACT

A water well pumping system for controlling the volume of fluid supplied to a supply reservoir from a primary reservoir and drawn off through an outlet conduit to the volume of fluid produced and pumped from the well. A fixed or variable resistance is interposed in piping between the primary and supply reservoir.

3 Claims, 2 Drawing Figures

WATER WELL PUMPING SYSTEM

BACKGROUND OF THE INVENTION

1. Field of the Invention

The present invention relates to home owners water well systems and more particularly to maintaining a water well pump system operable during demand in excess of the well potential.

Water well systems installed in some wells frequently pump the well dry necessitating priming the pump after water has accumulated in the borehole. This well system assures maintaining the pump primed and prevents using all of the water in the primary reservoir at the surface of the earth.

2. Description of the Prior Art

Prior patents generally disclose apparatus responsive to reservoir water level for actuating a pump in response to water usage to insure a supply of water without regard to whether or not the water well has sufficient reserve therein for pumping. Other patents disclose pressure responsive switches which energize an electric motor driven pump in response to a decrease in water pressure, as by opening a faucet or other valve.

This invention is believed distinctive over prior patents by providing a system which limits the quantity of water continually available from a water well supplied reservoir to equal the volume of water entering the borehole and pumped to the surface of the earth.

SUMMARY OF THE INVENTION

A water well is equipped with conventional water pumping equipment including a primary reservoir. A second or supply reservoir is located near and connected with the primary reservoir by piping. With the water producing potential per unit time of the well known, a choke nipple or restrictor, of known flow capacity per unit time at a predetermined pressure, equal to the water production of the conventional pumping system is interposed in the reservoir connecting piping. Water usage from the supply reservoir in excess of well production drains the supply reservoir and but does not drain the primary reservoir because its output is limited to equal well production by the choke nipple or restrictor.

The principal object of this invention is to provide a water well system for a relatively low volume water well which prevents pumping the well dry by water demand in excess of the production capacity of the well.

DESCRIPTION OF THE PREFERRED EMBODIMENTS

Figure 1:
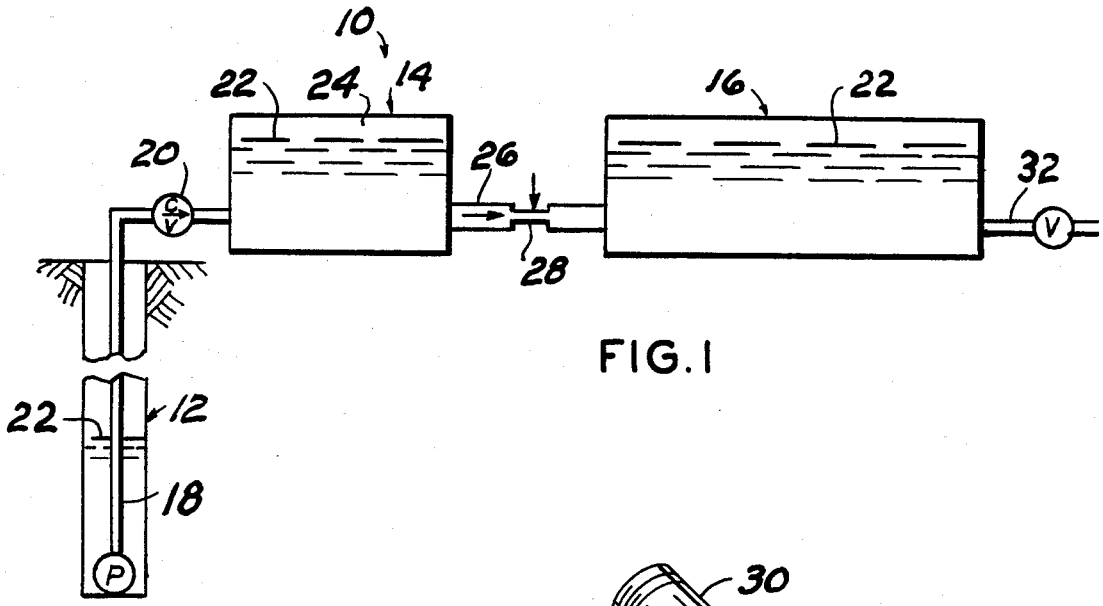
FIG. 1 is schematic.
Figure 2:
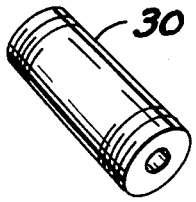
FIG. 2 is a perspective view of a flow restrictive nipple.

Like characters of reference designate like parts in those figures of the drawings in which they occur.

In the drawings:

The reference numeral 10 indicates the water pumping system as a whole comprising water well 12 and reservoirs 14 and 16. The water well 12 is supplied with casing not shown terminating above the earth formation or water producing zone. A submersible pump P is disposed in the well on the depending end of tubing 18 and connected with the primary tank 14 through a check valve 20. The pump P is connected with a source of electric energy, not shown, in a conventional manner for maintaining a predetermined pressure on the water 22 contained by the reservoir 14. Water in the reservoir 12 compresses the gas 24 therein to maintain the water under greater than atmospheric pressure. The water pressure is equal to the pump pressure minus the water head from the level of the inlet line containing the check valve 20 to the pump P.

The reservoirs 14 and 16 are connected for communication by normally open piping 26. The piping 26 permits the pump P to simultaneously fill both reservoirs with water. In the event the well 12 does not produce a relatively large volume of water, for example assuming the well is capable of producing a maximum of one or two gallons per minute a restrictor 28 is interposed in the piping 26. The restrictor 28 maybe a variable restrictor as shown or a fixed restrictor. In either event the restrictor permits a flow of fluid equal to the volume of fluid pumped from the well during the time that water is drawn from the supply reservoir 16 through a valve equipped drain conduit 32. The restrictor 28 may comprise a valve or other fitting, not shown, having an orifice of selected diameter. The orifice diameter is selected in accordance with the known water producing capacity of the pump and well under the preselected pressure on the water 22 so that only that quantity of water may be moved through the piping 26 from the primary reservoir to the supply reservoir. The small diameter bored nipple 30 is one example of a fixed resistance commonly called a choke nipple which may be interposed in the piping 26 to restrict transfer of water from the primary to the supply reservoir.

Obviously the reservoirs 14 and 16 may be juxtaposed or superposed with the restrictor 28 interposed in the abutting walls thereof, or a single reservoir may be utilized with a partition therein defining the separate reservoirs. In this event the restrictor 28 is placed in the partition wall.

Operation

In operation the pumping system is installed as described herein above with a fixed or variable resistance in the piping 26. The fixed or variable resistance element is chosen or adjusted in accordance with the volume of water per unit time pumped into the reservoir 14. When water is drawn from the supply tank 16 through the outlet 32 water from the reservoir 14 replaces the water drawn from the supply tank reducing the pressure from the reservoir 14 which energizes the pump P. In the event the supply tank 16 is emptied the flow restrictor 28 prevents complete draining of the primary reservoir 14 thus maintaining the well system operative.

Obviously the invention is susceptible to changes or alterations without defeating its practicability. Therefore, I do not wish to be confined to the preferred embodiment shown in the drawings and described herein.

I claim:

1. In a water well system including a well containing and producing a limited volume of water and having a bottom hole pump submerged therein and connected by tubing with a primary reservoir at the surface of the earth, the improvement comprising:

a supply reservoir having a normally closed demand outlet disposed adjacent said primary reservoir; and, means including a flow restrictor means providing fluid communication between said reservoirs for limiting the volume of fluid flow from said primary reservoir when the demand outlet is open to the fluid producing volume of the well.

2. The water well system according to claim 1 in which the fluid communicating means includes:

piping; and, wherein said flow restrictor means is manually adjustable in accordance with the known production volume of the well liquid.

3. The water well system according to claim 1 in which the flow restrictor means includes:

a fixed resistance having an orifice of predetermined diameter.

* * * * *